US006266840B1

(12) United States Patent
Munro

(10) Patent No.: US 6,266,840 B1
(45) Date of Patent: Jul. 31, 2001

(54) GRIP ENHANCING TOOTHBRUSH

(76) Inventor: David Munro, 2 Roedean Dr. #A103, Nashua, NH (US) 03063-5108

( * ) Notice: Subject to any disclaimer, the term of this patent is extended or adjusted under 35 U.S.C. 154(b) by 0 days.

(21) Appl. No.: 09/216,737

(22) Filed: Dec. 21, 1998

(51) Int. Cl.[7] ..... A46B 5/02; A46B 9/04

(52) U.S. Cl. ..... 15/167.1; 15/143.1; 15/145; 15/176.1; 16/430; 16/DIG. 12; D4/104; D4/138

(58) Field of Search ..... 15/143.1, 145, 15/167.1, 176.1, 176.6; D4/104, 138; 16/110.1, 421, 422, 430, 436, DIG. 12

(56) References Cited

U.S. PATENT DOCUMENTS

| | | | | |
|---|---|---|---|---|
| 99,161 | * | 1/1870 | Chandler | 15/143.1 |
| D. 227,825 | * | 7/1973 | Runckel | D4/104 |
| D. 345,256 | * | 3/1994 | Khin | D4/104 |
| 1,859,425 | * | 4/1932 | Bell | 15/176.6 X |
| 2,360,745 | * | 10/1944 | Vogel | 15/167.1 |
| 3,181,189 | * | 5/1965 | Leyden | 15/145 X |
| 4,780,924 | * | 11/1988 | Hansen et al. | 15/176.1 |
| 4,809,389 | * | 3/1989 | Breitschmid | 15/167.1 |
| 4,951,533 | * | 8/1990 | Hillinger | 16/DIG. 12 X |
| 5,097,566 | * | 3/1992 | Decker et al. | 16/421 |

FOREIGN PATENT DOCUMENTS

| | | | | |
|---|---|---|---|---|
| 23643 | * | 12/1905 | (GB) | 15/143.1 |

* cited by examiner

*Primary Examiner*—Mark Spisich
(74) *Attorney, Agent, or Firm*—Cahn & Samuels, LLP

(57) ABSTRACT

A toothbrush is provided having an enhanced grip handle. The toothbrush includes a head, a neck portion and a handle, connected to the head via the neck portion. The handle may be provided with a multiplicity of small, inverted V-shaped protrusions. Each of these protrusions preferably have a substantially flattened vertex to promote easy and sure gripping by the user. In addition, drainage grooves may be disposed in the handle to drain water from the protrusions.

14 Claims, 3 Drawing Sheets

GRIP ENHANCING TOOTHBRUSH

FIELD OF THE INVENTION

This invention relates to hand-held oral hygiene devices. More particularly, the invention relates to a toothbrush having a handle with improved grip.

BACKGROUND OF THE INVENTION

The process of brushing one's teeth generally results in the toothbrush coming into contact with water. Frequently, when rinsing the toothpaste from the head of the toothbrush, the toothbrush handle is exposed to water. Often, the user will tightly grasp the toothbrush between her thumb and her forefinger to control the brushing motion. When the toothbrush handle is wet, it is difficult to grip and may slip out of the user's hands. Dental professionals agree that this can result in inadequate and uneven cleaning of the teeth.

There are several toothbrushes available on the market that include handles with grip enhancing features. For example, a toothbrush available from the Colgate-Palmolive Company under the tradename PRECISION has a handle bearing a pair of ridges and having a rubber strip coated on its surface. The rubber strip is placed on the handle to make it easy to grip, however, there is no provision for increased drainage.

Another commercially available toothbrush is distributed by DeMoulas & market Basket of Tewksbury, Mass. under the trade name MARKETBASKET. This toothbrush has small rubber strip segments placed on the outer surface at the extreme ends of the handle. However, the surface area of the handle between the extreme ends does not include the rubber surface. Like the previously described toothbrush, there is no provision for enhanced drainage.

Yet another commercially available toothbrush is described in U.S Pat. No. 5,052,071. This patent discloses a toothbrush having a handle with embossed grip mats. The embossing is in the form of a multitude of dimples arranged on the grip mat.

While the above described commercially available toothbrushes focus on improving the grip, they do not provide any mechanism for increasing drainage. Accordingly, there is a need for a toothbrush that provides rapid and efficient drainage of water from the handle to enhance the user's grip and to facilitate even and thorough teeth cleaning.

SUMMARY OF THE INVENTION

An object of the invention is to provide a toothbrush with an improved handle that reduces slippage of the user's fingers when the toothbrush is in use.

Another object of the invention is to provide a toothbrush having a handle with superior drainage characteristics.

Still another object of the invention is to provide a toothbrush having a handle with superior drainage characteristics and having a replaceable head.

These and other objects may be realized by the toothbrush of the present invention. In accordance with an aspect of the invention, the toothbrush comprises a head including a plurality of bristles. A neck portion interconnects the head with a handle. The handle includes a plurality of inverted V-shaped protrusions for enhancing a user's grip.

In accordance with another aspect of the invention, the toothbrush includes a head having a plurality of bristles. A neck portion is integrally formed with the head and a handle is integrally formed with the neck portion. The handle includes a plurality of inverted V-shaped protrusions where the inverted V-shaped protrusions include a flattened vertex. The handle further includes a plurality of drainage grooves, wherein each drainage groove intersects a corresponding protrusion and extends towards an edge of the handle. In accordance with still another aspect of the invention, the toothbrush comprises a head including a plurality of bristles. A neck portion is interconnected with the head. The neck portion includes a forked attachment member, the forked attachment member having first and second tines, the first tine including a stub. Preferably, the second tine includes a slanted end and is about ¼" or more shorter than the first tine. A handle is provided and is defined by a housing including a plurality of inverted V-shaped protrusions, the inverted V-shaped protrusions preferably having a substantially flattened vertex. The handle further includes a plurality of drainage grooves, each drainage groove intersecting a corresponding protrusion and extending towards an edge of said handle. The handle is also provided with first and second opposing apertures, one of the opposing apertures engaging the stub to releasably interconnect the head and neck to the handle thus locking the brush in position to be used.

DETAILED DESCRIPTION OF THE EMBODIMENTS

The invention comprises a toothbrush having an improved handle structure. The toothbrush of the present invention includes a head 10 having a plurality of bristles 12 disposed thereon. A handle 14 is interconnected to head 10 via neck portion 16.

Figure 2:
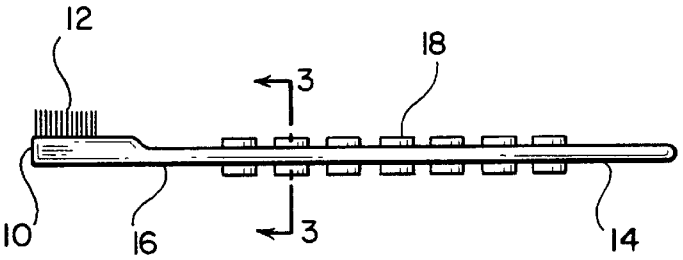
FIG. 2 is a side view of the toothbrush of FIG. 1.

In accordance with an aspect of the invention, the handle 14 is preferably provided with a plurality of protrusions 18 for enhancing the user's grip. The protrusions 18 are provided on the front and back surface of handle 14. As depicted in FIG. 2, the protrusions 18 preferably have an inverted V-shape with a substantially flattened vertex.

Figure 3:
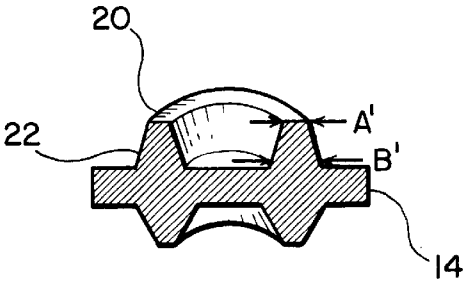
FIG. 3 is an exploded cross sectional view of a protrusion taken along line 3—3 of FIG. 2.

FIG. 3 depicts the cross section of a protrusion 18. As previously stated, preferably the protrusions 18 have an inverted V configuration with a substantially flattened vertex. For example, a top surface 20 of the protrusions 18 is preferably substantially flat and includes a lengthwise dimension A' of about 0.005 inches allowing the thumb and fingers to comfortably rest on and effortlessly wrap around the protrusions 18. A bottom surface 22 may be integrally formed or fixedly or removably attached to a surface of the handle 14. The bottom surface 22 has a lengthwise dimension B' that is greater than the lengthwise dimension A' of the top surface 20.

Figure 7:
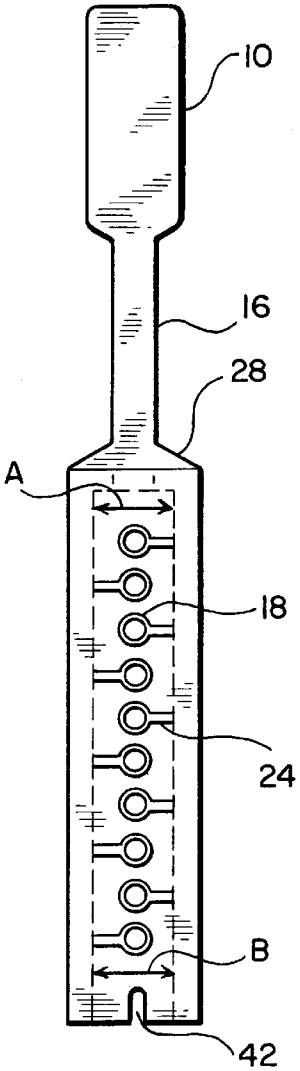
FIG. 7 is a rear view of a toothbrush in accordance with an embodiment of the invention.

In accordance with an aspect of the invention as illustrated in FIG. 7, handle 14 is provided with a plurality of drainage grooves 24 that intersect corresponding protrusions 18 and extend to an edge of handle 14. Water that would ordinarily accumulate along the periphery of protrusions 18 may be readily discharged through drainage grooves 24.

It is desirable for the drainage grooves 24 to have a depth sufficient to allow rapid drainage without compromising the strength of the handle. Preferably, the grooves have a depth of about 1/16" or less.

Figure 4:
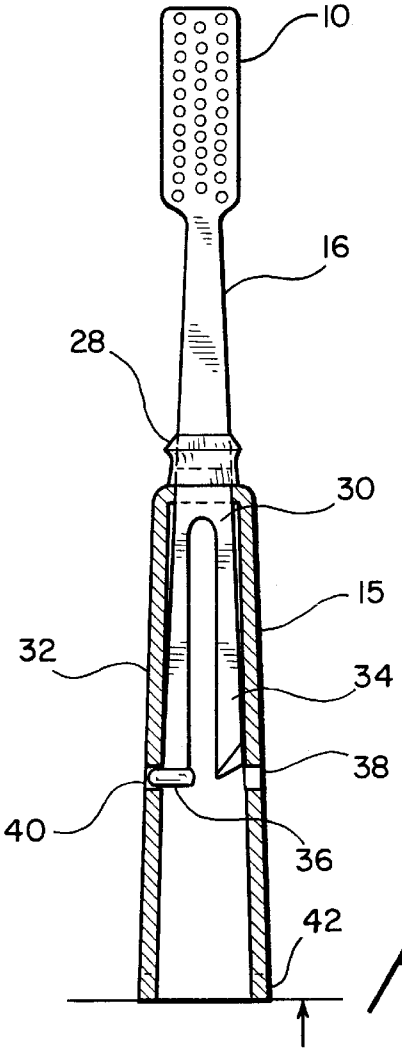
FIG. 4 is a rear view of a toothbrush in accordance with an embodiment of the invention including a partial cut-away view of the hollow handle.
Figure 1:
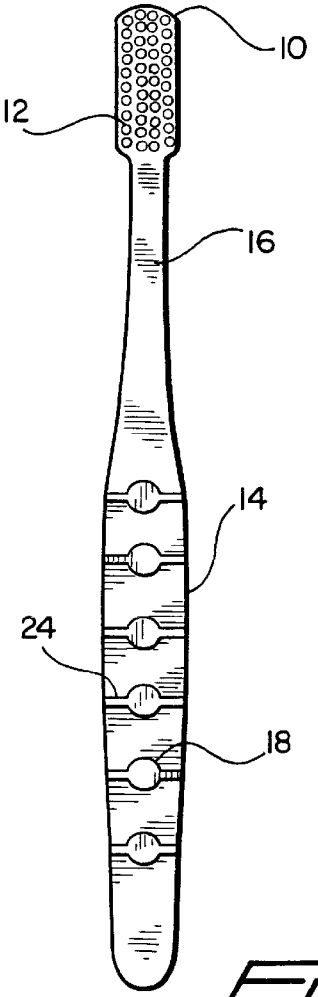
FIG. 1 is a front view of a toothbrush in accordance with a first embodiment of the invention.

In accordance with another embodiment of the invention, a handle 14 may be releasably interconnected with neck portion 16 as depicted in FIG. 4. Many of the elements of this embodiment are identical to elements of the previously described embodiment. These elements are referred to by the same reference numbers and elements not previously described bear new reference numbers.

Figure 6:
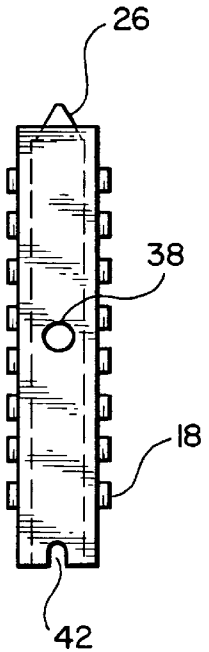
FIG. 6 is a side view of the handle of FIG. 4.
Figure 5:
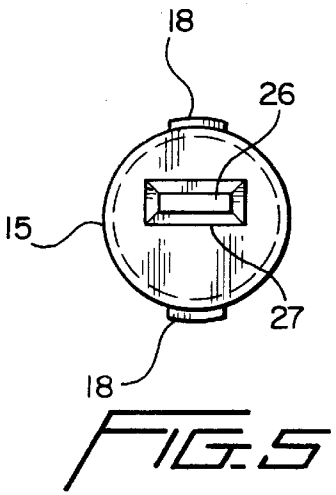
FIG. 5 is a top view of the handle of FIG. 4.

FIG. 4 depicts a toothbrush in accordance with this embodiment. As illustrated, handle 14 comprises a substantially hollow housing 15. As best shown in FIGS. 5 and 6, hollow housing 15 includes a collar 26 having an opening dimensioned to receive neck portion 16. The collar 26 preferably includes four adjacent sections defining a tapered opening 27. A drip edge 28 preferably circumscribes neck portion 16 and serves to deflect water from the housing 15. As shown in FIG. 7, the drip edge 28 is preferably slightly wider than the diameter of handle 14 at the distal end.

To facilitate coupling of neck portion 16 and housing 15, neck portion 16 is provided with an attachment member 30. In accordance with a preferred aspect of the invention, attachment member 30 comprises first and second tines 32 and 34. First tine 32 includes a stub 36 extending substantially orthogonally from tine 32. Tine 34 is preferably shorter than tine 32 by at least ¼" and preferably tapered to facilitate insertion of tines 32 and 34 into opening 27. Housing 15 is provided with opposing apertures 38 and 40 at a position along housing 15 that allows engagement of stub 36 when neck portion 16 is fully inserted into housing 15. In addition, drip edge 28 serves as a stop limiting insertion of brush 5 into the housing 15 and positioning stub 36 adjacent apertures 38 and 40.

Figure 8:
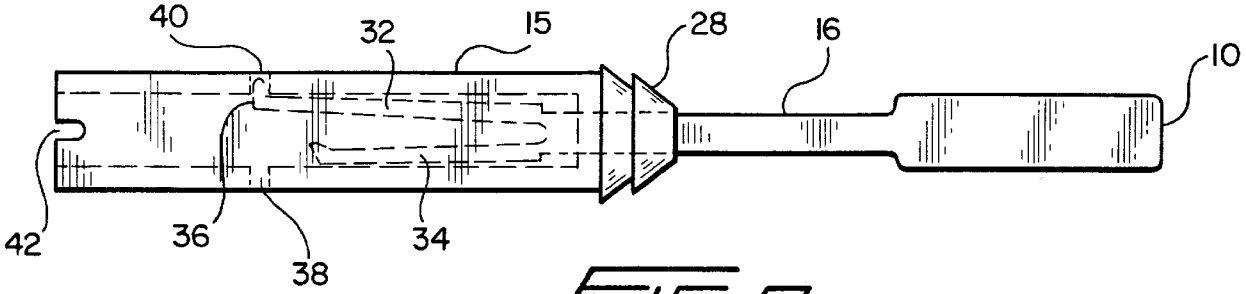
FIG. 8 is a rear view of a toothbrush in accordance with an embodiment of the invention including a partial cut-away view of the hollow handle depicted immediately prior to removal of the toothbrush from the handle.
Figure 9:
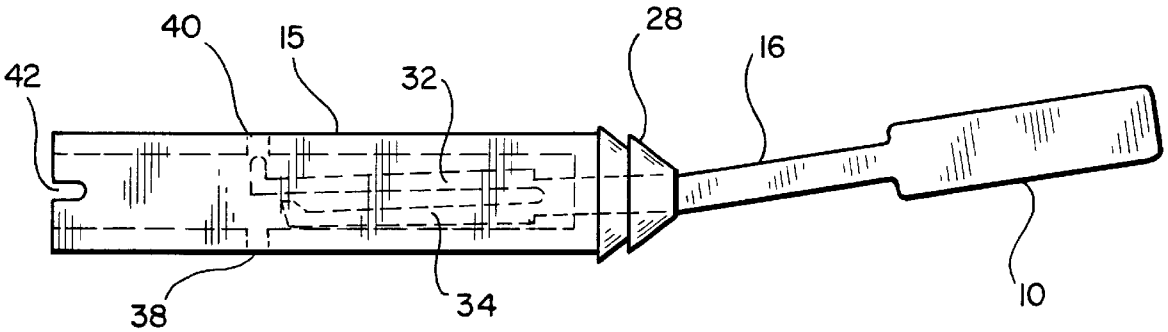
FIG. 9 depicts a rear view of a toothbrush in accordance with an embodiment of the invention including a partial cut-away view of the hollow handle illustrating displacement of the head and tines during removal of the toothbrush from the handle.

Insertions and removal of the toothbrush of this embodiment is described with reference to FIGS. 8 and 9. The handle 14 is held in place while the brush 5 is pushed in the area of head 10 towards the first tine 32 that includes stub 36. The stub 36 is thus released from the aperture 40 and brush 5 may then be may be readily pulled directly out of the handle 14.

The bottom surface of housing 15 allows the entire toothbrush assembly to stand upright on a flat lavatory surface such as a sink. Thus, the toothbrush can drain when it is not in use. To facilitate drying, the bottom surface of the housing 15 is provided with a plurality of vents 42.

Although shown and described is what is believed to be the most practical and preferred embodiments, it is apparent that departures from specific designs and methods described and shown will suggest themselves to those skilled in the art and may be used without departing from the spirit and scope of the invention.

The present invention is not restricted to the particular constructions described and illustrated, but should be construed to cohere with all modifications that may fall within the scope of the appended claims.

What is claimed is:

1. A toothbrush comprising:

a head including a plurality of bristles;

a neck portion; and a handle, interconnected with said head by said neck portion, said handle including a plurality of inverted V-shaped annular protrusions, each of said plurality of protrusions including a substantially flattened vertex to facilitate enhanced grip wherein each protrusion includes a substantially flat top surface at the vertex thereof and a bottom surface adjacent the handle, the wall thickness of each protrusion at the top surface thereof defined by the inner and outer surfaces of the annular protrusions being about 0.005 inches and the wall thickness of each protrusion at the bottom surface defined by the inner and outer surfaces of the annular protrusions being greater than that at the top surface thereof such that the protrusions taper from the bottom surface to the top surface thereof.

2. The toothbrush of claim 1 further comprising a plurality of drainage grooves disposed in said handle, each drainage groove intersecting a corresponding protrusion and extending to an edge of said handle.

3. The toothbrush of claim 1 wherein the plurality of protrusions are disposed along the length of said handle.

4. The toothbrush of claim 3 wherein said handle includes first and second surfaces and the plurality of protrusions are disposed on both the first and second surfaces.

5. The toothbrush of claim 1 wherein said handle is releasably interconnected with said neck portion.

6. The toothbrush of claim 5 wherein said neck portion includes a forked attachment member, the forked attachment member including first and second tines, the first tine having a stub extending therefrom.

7. The toothbrush of claim 6 wherein the stub extends substantially perpendicularly from the first tine.

8. The toothbrush of claim 7 wherein the second tine includes a tapered end portion.

9. The toothbrush of claim 6 wherein said handle includes a housing having an opening for receiving the forked attachment member and first and second opposing apertures, one of the first and second opposing apertures receiving the stub.

10. The toothbrush of claim 9 wherein the housing includes a plurality of vents.

11. The toothbrush of claim 6 wherein the first tine is longer than the second tine.

12. The toothbrush of claim 11 wherein the first tine is about ¼ inch longer than the second tine.

13. A toothbrush comprising:

a head including a plurality of bristles;

a neck portion integrally formed with said head; and a handle, integrally formed with said neck portion, said handle including a plurality of inverted V-shaped annular protrusions, each protrusion having a substantially flattened vertex, each protrusion including a substantially flat top surface at the vertex thereof and a bottom surface adjacent the handle, the wall thickness of each protrusion at the top surface thereof defined by the inner and outer surfaces of the annular protrusion and the wall thickness of each protrusion at the bottom surface defined by the inner and outer surfaces of the annular protrusions being greater than that at the top surface thereof such that the protrusions taper from the bottom surface to the top surface thereof, said handle further including a plurality of drainage grooves, each drainage groove intersecting a corresponding protrusion and extending towards an edge of said handle.

14. A toothbrush assembly comprising:

a head including a plurality of bristles;

a neck portion interconnected with said head, said neck portion including a forked attachment member, the forked attachment member having first and second tines, the first tine including a stub;

a handle defined by a housing including a plurality of inverted V-shaped protrusions, at least one of the inverted V-shaped protrusions having a substantially flattened vertex, said handle further including a plurality of drainage grooves, each drainage groove intersecting a corresponding protrusion and extending towards an edge of said handle, said handle further including first and second opposing apertures, one of the opposing apertures engaging the stub to releasably interconnect said head and neck portion to said handle; and a drip edge attached to said neck portion to deflect liquid from said handle and to limit insertion of the forked attachment member into said handle wherein the handle includes a proximal end and a distal end, the distal end including a plurality of vents and having a first diameter that is less than the width of the drip edge.

* * * * *